US005843262A

United States Patent [19]

Rosendale et al.

[11] Patent Number: 5,843,262

[45] Date of Patent: Dec. 1, 1998

[54] MULTI-SURFACE NOVELTY PIECE AND METHOD FOR MAKING THE SAME

[75] Inventors: David Rosendale, Torrance; Rebecca Forsythe, Topanga, both of Calif.

[73] Assignee: Intervisual Communications Inc., Santa Monica, Calif.

[21] Appl. No.: 840,845

[22] Filed: Apr. 17, 1997

[51] Int. Cl.[6] ..... A63H 33/00

[52] U.S. Cl. ..... 156/227; 156/252; 156/257; 446/488

[58] Field of Search ..... 446/488; 156/226, 156/227, 252, 257, 277

[56] References Cited

U.S. PATENT DOCUMENTS 2,007,421 3/1935 Coughlin ..... 446/488

OTHER PUBLICATIONS

Murray, William. *Paper Folding for Beginners.* 1960. pp. 8–11.

*Primary Examiner*—Richard Crispino
*Assistant Examiner*—Michael A. Tolin
*Attorney, Agent, or Firm*—Gerald L. Price

[57] ABSTRACT

A novelty piece is fabricated from a single sheet of paper printed on both sides with indicia in registration. Scoring, perforating and cut lines are provided at predetermined positions and an adhesive is applied at preselected locations and the sheet is then folded and adhered in the folded position. a second fold into an adhered position followed by a trimming yields a completed piece ready for use. The completed piece can be selectively opened into one of two positions to display different indicia. The selective display of different indicia with either opened position can be utilized to create illusions or a multiple selection or fortune telling game.

3 Claims, 5 Drawing Sheets

MULTI-SURFACE NOVELTY PIECE AND METHOD FOR MAKING THE SAME

BACKGROUND OF THE INVENTION

1. Field of the Invention

The invention relates to novelty pieces; and, more particularly, to a single novelty piece adapted to be selectively opened in either of two positions whereby each position displays different indicia for applications such as games and illusions, and a method for making the same.

2. Description of the Prior Art

The general type of novelty piece of the instant invention is well known in the prior art inasmuch as children have made them by folding paper and depending on the indicia applied have called them names such as "cootie catcher" and "fortune teller". In the cootie catcher version, one of the two opened positions has the surfaces blank and the other position has bugs drawn on them. The usual game is for a child holding the cootie catcher to come up to another child displaying the blank opened position. The cootie catcher would then be touched to the child's body and reopened to the second position creating the illusion that such bugs were captured on the child. In the fortune telling version, various fortunes could be written on the surfaces exposed with each of the two open positions and secondary indicia could be applied to underlying surfaces to be exposed in a manner depending on the particular game or the like that it is being used with. While such pieces with printed indicia have been used as prizes or premiums in cereal boxes or caramelized popcorn boxes for example, because of the multiple and complex folds required to fabricate them the labor is quite high for low cost applications and providing just a printed flat sheet with folding instructions has not been found to be commercially accepted.

SUMMARY OF THE INVENTION

It is an object of this invention to provide a novelty piece which can be opened in two selective positions each appearing the same but each displaying different indicia folded in different orientations to present a plurality of different sides or faces with such piece capable of being fabricated by machine.

It is another object of this invention to provide a method for making novelty pieces of the foregoing object utilizing conventional printing and paper fabrication machinery and equipment.

These and other objects are preferably accomplished by providing a novelty piece cut from a single sheet of paper or other flexible printable substrate having both sides of the sheet printed with indicia in registration. Predetermined perforating, cutting and scoring is then performed and adhesive is applied to predetermined positions. The sheet is then folded and adhered in the folded position and then folded and adhered into a second position which is trimmed to yield a completed novelty piece ready for use.

Another important object of the invention is that the within method of producing the within novelty piece can be performed on conventional printing and paper fabrication equipment eliminating costly hand labor and that the resulting novelty piece is ready to be used with no further fabrication or tearing of edges or the like by the ultimate user.

DESCRIPTION OF THE PREFERRED EMBODIMENT

Figure 2B:
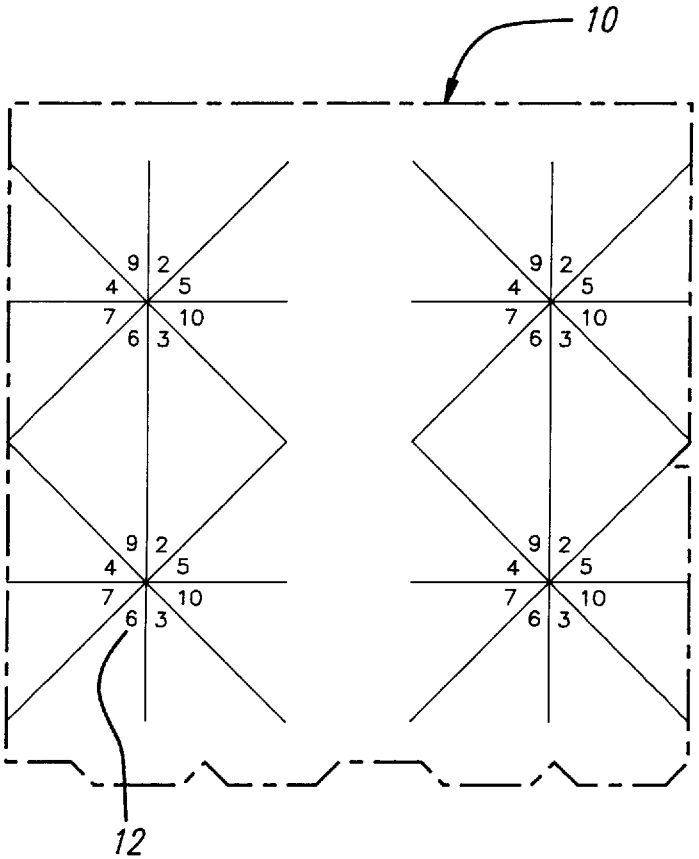
FIG. 2B is a plan view of the rear side of the single sheet of paper or flexible substrate shown in FIG. 2A with indicia applied to the rear side and in registration with the indicia applied to the front side.
Figure 2A:
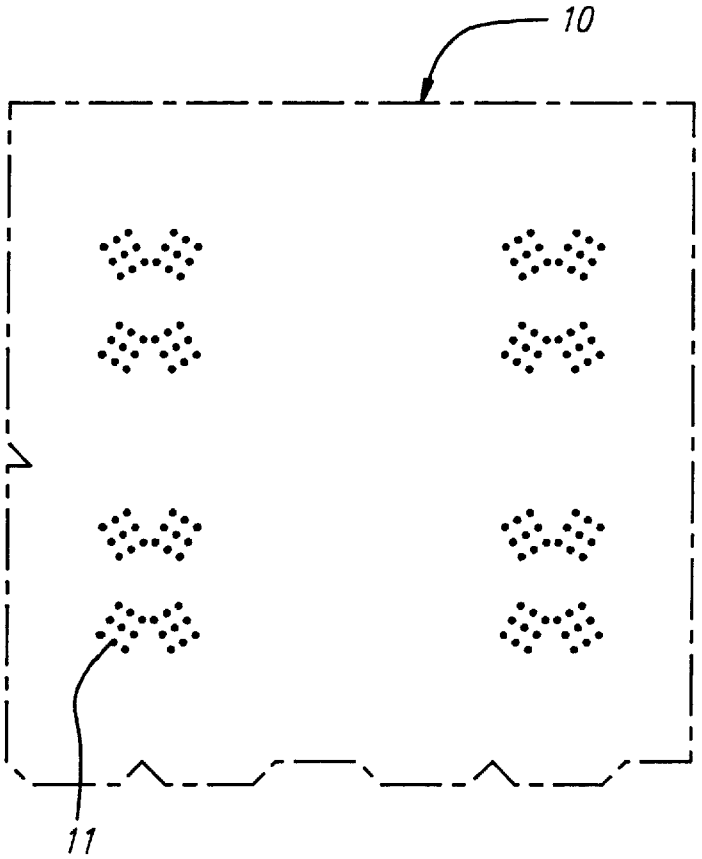
FIG. 2A is a plan view of the front side of a single sheet of paper or flexible substrate here showing indicia applied to the front side.

Referring now to FIG. 2A of the drawing, a single sheet 10 of paper or flexible printable substrate is shown having a series of indicia 11 printed thereon wherein each indicia 11 in the series will generally conform to the center of each novelty piece 32 (FIG. A). In the completed novelty piece, indicia 11 will be that displayed upon one of the two open positions of the novelty piece 32, while in applications such as fortune tellers and games, a second indicia 12 in registration with the first indicia 11, is printed on the opposite side of sheet 10 as shown in FIG. 2B.

Figure 2E:
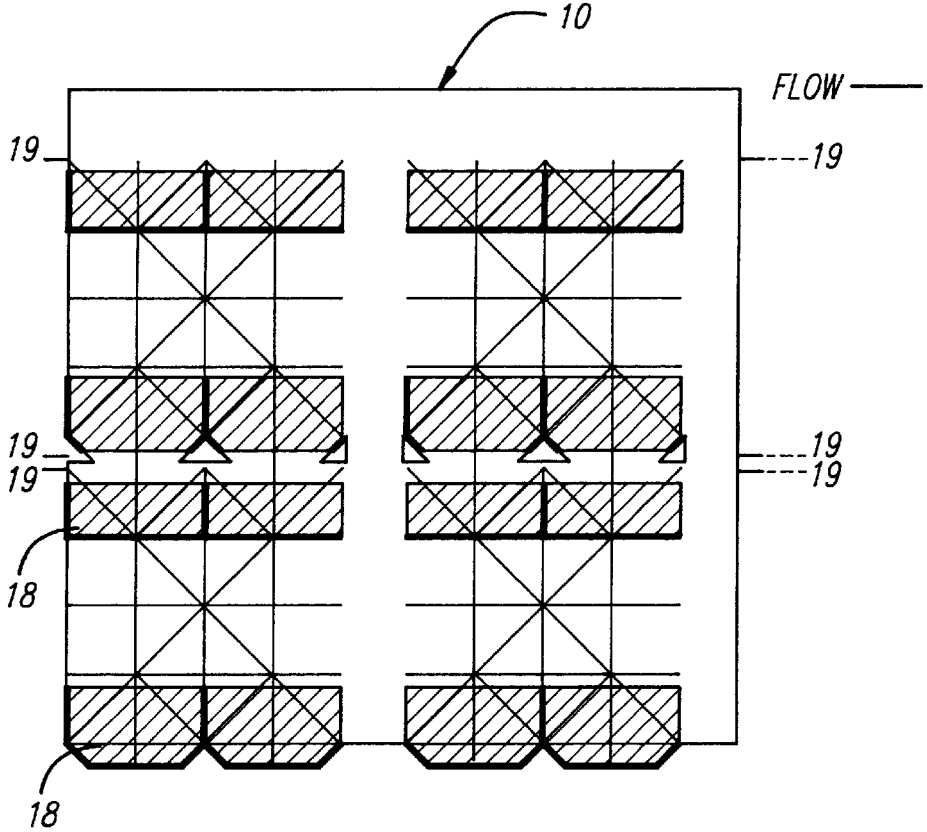
FIG. 2E is a plan view of the front side of the sheet shown in FIG. 2A depicting the predetermined areas where the adhesive is applied.
Figure 2C:
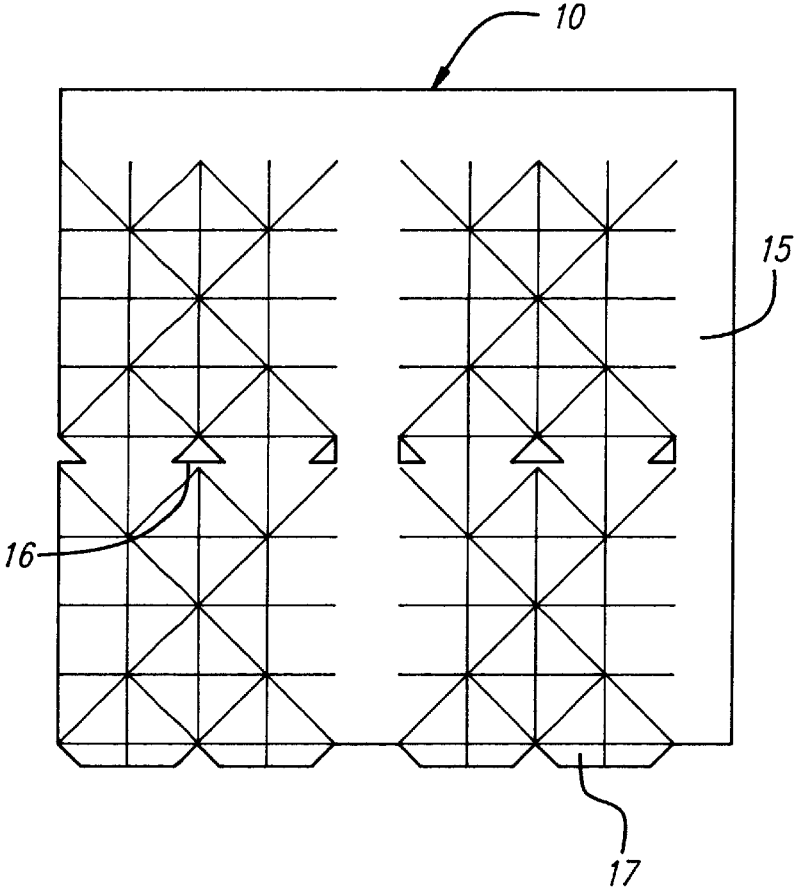
FIG. 2C is a plan view of the front side of the sheet shown in FIG. 2A illustrating the cutting, perforating and scoring operation.
Figure 2D:
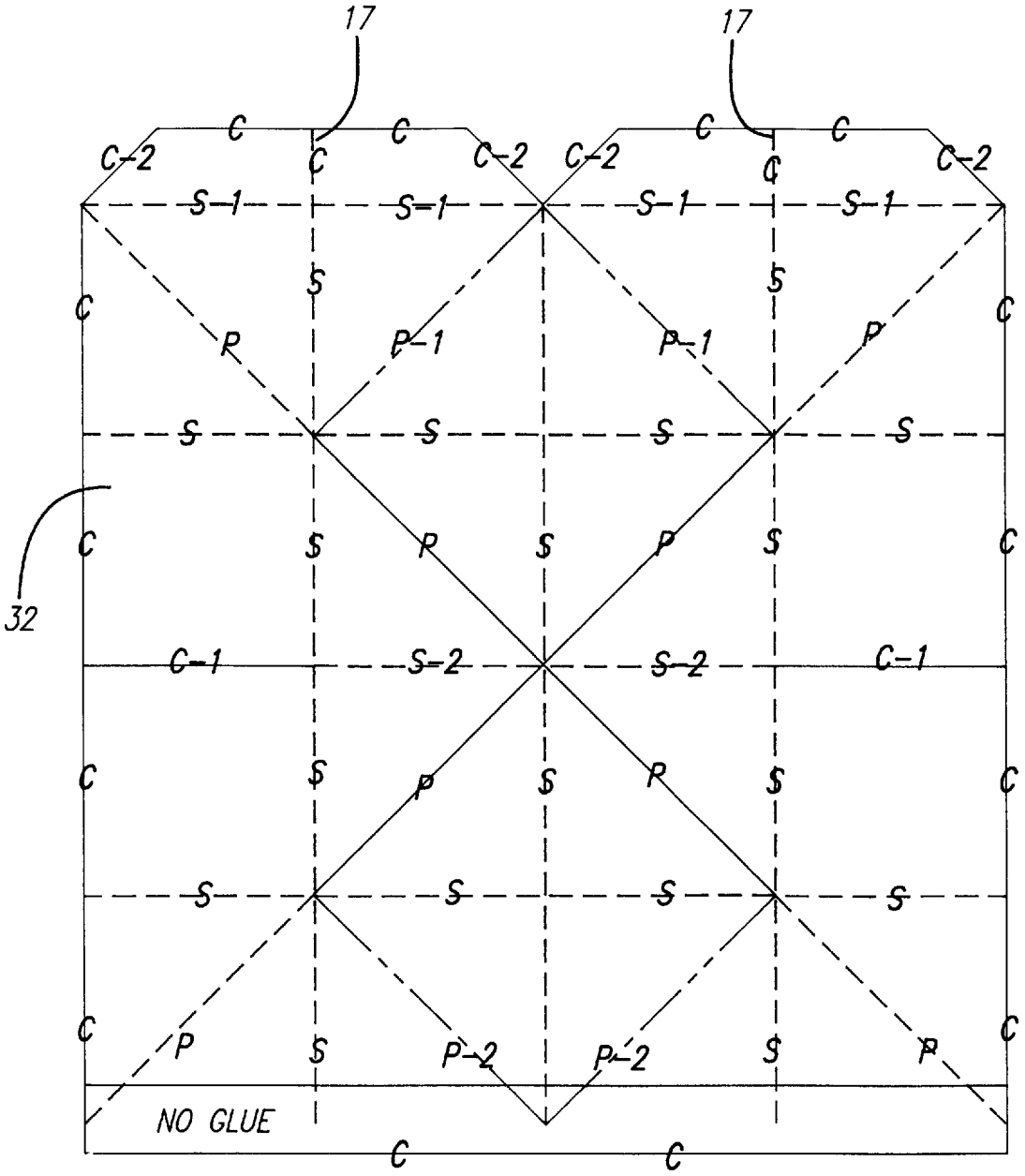
FIG. 2D is a plan view of an enlarged portion of the sheet shown in FIG. 2C illustrating the details of the cutting, scoring and perforating performed on each novelty piece.

As seen by referring to FIG. 2C, a plurality of vertical, horizontal and diagonal die cuts, scores and perforations collectively referenced as 15, are made to each novelty piece in its flat sheet form to facilitate further fabrication. By referring to FIG. 2D which is an enlarged section of the sheet 10 of FIG. 2C showing a single novelty piece 32 in progress of fabrication, the cuts, scores and perforation to facilitate further fabrication are shown in detail. Die cuts "c" are on horizontal and vertical lines about the perimeter of the flat novelty piece to separate it from the overall sheet 10 and additional cuts "c-1" are made on a horizontal center line from each outer edge to one fourth the way to the center of the novelty piece as shown in FIG. 2D. In addition, cuts "c-2" are made diagonally at the top of the piece from the center and two top corners and a horizontal score line "s-1" is made below the top of the novelty piece to form glue tabs 17 to facilitate further fabrication.

With further reference to FIG. 2D, it is further seen that perforations "p" to facilitate subsequent separation are made diagonally through the center of the novelty piece 32 and additional diagonal perforations "p-1" are made from the center of the top of the novelty piece to the center of each upper quadrant of the novelty piece 32. Also, diagonal perforations "p-2" are made from the center of the bottom of the novelty piece 32 to the center of each lower quadrant of the novelty piece. Score "s" is made vertically through the center and also horizontally through the centers of each quadrant of the novelty piece 32 to facilitate folding. In addition, horizontal scores "s-2" are made from the center of the novelty piece 32 to the center of each vertical half The spacing of the grid of cuts and scores shown in FIG. 2D are about three fourths of an inch. Of course, any suitable dimension may be utilized. It is also pointed out that the cuts, scores and perforations shown in FIGS. 2C and 2D may in actual machine fabrication extend past the actual size of the novelty piece. It will also be seen that the intersection of the diagonal cuts "c-2" will create triangular cutouts 16 between adjacent novelty pieces on sheet 10 to facilitate folding.(FIG. 2C)

Figure 3A:
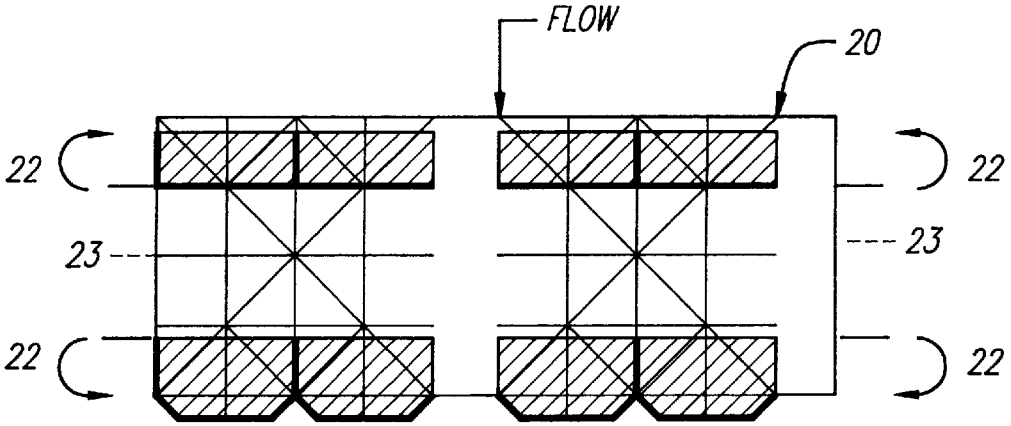
FIG. 3A is a plan view of a portion of the front side of the sheet shown in FIG. 2A which will yield two completed novelty pieces of the within invention.
Figure 3B:
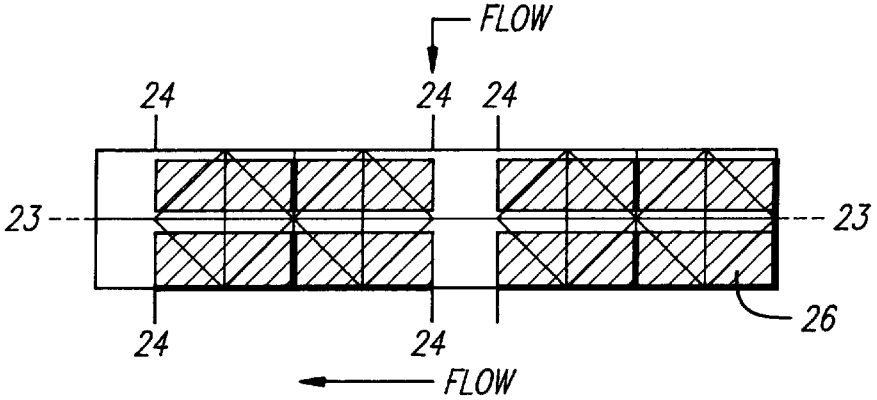
FIG. 3B is a plan view illustrating the portion of the sheet shown in FIG. 3A with a first folding and adhering operation.

To accomplish the aforestated gluing in carrying out the instant invention, the glue or other suitable adhesive must be accurately applied at predetermined locations. As shown in FIG. 2E, glue indicia strips 18 are provided at the top and bottom of each of the separate novelty pieces 32. A suitable adhesive is applied along the indicia 18 and the sheet 10 is slit and trimmed at lines 19 and folded about fold lines 22 (FIG. 3A) and upon folding the glue tabs 17 will now underlay the top fold portion as shown in FIG. 3B resulting in a two piece segment of sheet 10 (FIG. 3B).

Figure 3C:
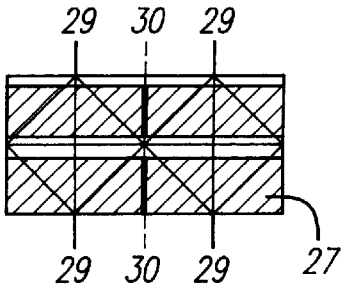
FIG. 3C is a plan view illustrating a single novelty piece in progress of fabrication resulting from the slitting of the sheet shown in FIG. 3B.
Figure 3D:
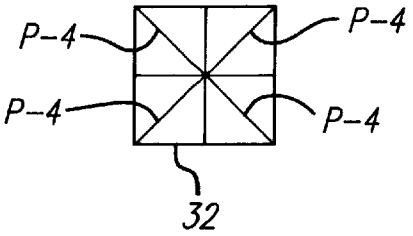
FIG. 3D is a plan view of a fully completed novelty piece ready for use resulting from a second folding and adhering operation to the novelty piece in progress of fabrication shown in FIG. 3C.

After the folded sections have adhered, a further slitting and trimming on lines 24 (FIG. 3B) results in a single piece shown in FIG. 3C which is again folded about lines 29 which results in the finished piece 32 shown in FIG. 3D.

Figure 1C:
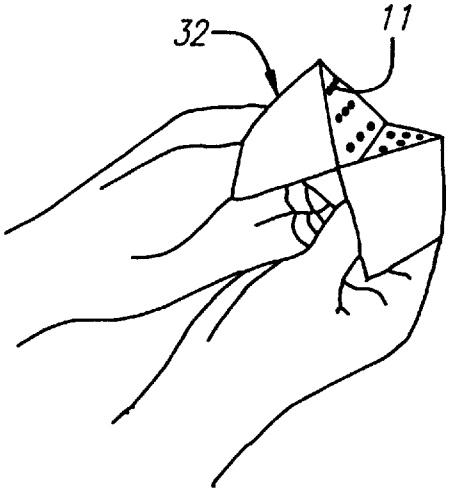
FIG. 1C is a perspective view of the novelty piece of FIG. 1A here showing indicia exposed to create the illusion that such indicia appeared on the same surfaces first displayed blank in FIG. 1B.
Figure 1B:
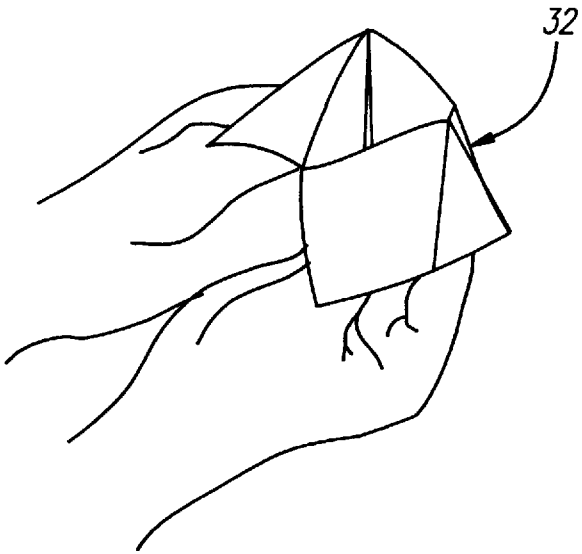
FIG. 1B is a perspective view of the novelty piece of FIG. 1A depicting it being opened in a first position with no visible indicia.
Figure 1A:
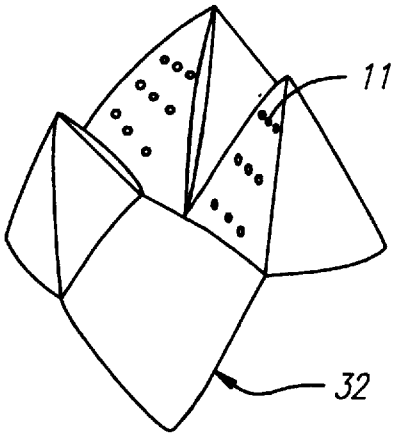
FIG. 1A is a perspective view of the novelty piece of the invention.

The flat finished piece 32 only requires a remaining perforated section "p-4" to be separated by the end user and it is ready for use as graphically depicted in FIGS. 1A through 1C.

We claim:

1. A method for fabricating a multi-surface novelty piece of the type that can be selectively opened into one of two distinct positions to display indicia in at least one of said positions comprising the steps of:

imprinting a first indicia on a sheet of flexible printable substrate;

cutting a series of cuts generally defining a square with said indicia centered within said square;

forming a series of vertical score lines dividing the square into four substantially equal vertical segments;

forming a series of horizontal score lines dividing the square into four substantially equal segments;

forming a pair of diagonal perforation lines from the four corners of said square and passing through the center of said square;

cutting a horizontal cut from the center of each vertical side of said square to the center of its respective vertical half of said square;

forming a pair of diagonal perforation lines from the center of each horizontal side of said square to the center of each of its respective adjacent quadrants;

applying adhesive to the upper half of the upper quadrants and lower quadrants of said square;

folding the lower half of the lower two quadrants of said square about a horizontal center line through said quadrants;

folding the upper half of the upper two quadrants of said square about a horizontal center line through said quadrants; and folding each half of the rectangle resulting from said folding along a vertical center line whereby the faces which come into contact as a result of folding each half of the rectangle adhere to each other forming a completed novelty piece.

2. The method of claim 1 further including the step of imprinting a second indicia on the opposite side of said sheet wherein said first indicia is in alignment and registration with said second indicia.

3. The method of claim 1 further including the step of cutting diagonal cuts from the top corners and center of said square to define glue tabs to facilitate fabrication.

* * * * *